US011885598B2

(12) United States Patent
Hull et al.

(10) Patent No.: US 11,885,598 B2
(45) Date of Patent: Jan. 30, 2024

(54) SHOOTING TARGET

(71) Applicant: Hammer Targets, LLC, Emmett, ID (US)

(72) Inventors: Jeffrey Ross Hull, Emmett, ID (US); Miriam Emelia Hull, Emmett, ID (US)

(73) Assignee: Hammer Targets LLC, Emmett, ID (US)

( * ) Notice: Subject to any disclaimer, the term of this patent is extended or adjusted under 35 U.S.C. 154(b) by 264 days.

(21) Appl. No.: 17/409,673

(22) Filed: Aug. 23, 2021

(65) Prior Publication Data

US 2022/0057179 A1 Feb. 24, 2022

Related U.S. Application Data

(60) Provisional application No. 63/068,691, filed on Aug. 21, 2020.

(51) Int. Cl.
*F41J 5/24* (2006.01)

(52) U.S. Cl.
CPC ..... *F41J 5/24* (2013.01)

(58) Field of Classification Search
CPC ..... F41J 5/24; F41J 5/18
See application file for complete search history.

(56) References Cited

U.S. PATENT DOCUMENTS 2,538,118 A 1/1951 Miller
3,143,817 A 8/1964 Paulson
3,540,729 A 11/1970 Rahberger
3,601,353 A 8/1971 Dale
3,602,504 A 8/1971 Chapman
4,249,715 A 2/1981 Repp
4,461,220 A 7/1984 Wetzel
4,524,533 A * 6/1985 Still, Jr. ..... G09F 21/04 40/607.04
5,735,494 A 4/1998 Kurk
6,296,252 B1 * 10/2001 Hubka ..... A63B 63/00 273/384
6,334,596 B1 1/2002 Temple
6,398,215 B1 * 6/2002 Carroll ..... F41J 1/10 473/439
6,606,829 B2 8/2003 Benincasa
7,089,694 B2 8/2006 Allen
(Continued)

*Primary Examiner* — Jeffrey S Vanderveen
(74) *Attorney, Agent, or Firm* — Scott Swanson; Shaver & Swanson

(57) ABSTRACT

A modular target having a support pole and a head. The head is preferably removable. The head is configured for removable attachment of a target. The head has a rail onto which a sleeve of a target is attached. The rail is preferably cylindrical. The target is configured with a sleeve that slides over the rail. Preferably a shooting face extends from the sleeve. Further, the shooting face is configured such that a moment arm allows the shooting face to hang at a 5-20 degree angle from vertical, with the preferred angle being 10 degrees. In a preferred embodiment the modular target utilizes a removably head configured with a neck that attaches to a vertical support pole. The vertical support pole preferably has a slide hammer attached that allows for easier placement of the target in the ground. Preferably the support pole has a fin that serves to resist rotation of the support pole when the target is hit by a projectile fired by a firearm.

17 Claims, 9 Drawing Sheets

(56) References Cited

U.S. PATENT DOCUMENTS

| | | | | |
|---|---|---|---|---|
| 7,988,155 | B2 * | 8/2011 | Wyrick | F41J 7/00 273/407 |
| 9,151,070 | B2 | 10/2015 | Smith | |
| 10,132,599 | B2 | 11/2018 | Trimbath | |
| 10,408,580 | B1 * | 9/2019 | Pierce | F41J 7/02 |
| 10,451,389 | B2 * | 10/2019 | Urban | F41J 1/10 |
| 11,248,881 | B2 * | 2/2022 | Guedon, II | F41J 7/04 |
| 2003/0070821 | A1 | 4/2003 | McPhillips | |
| 2005/0274083 | A1 | 12/2005 | Shearer | |
| 2006/0011789 | A1 | 1/2006 | Bergh | |
| 2006/0284035 | A1 | 12/2006 | Crosby | |
| 2010/0225063 | A1 * | 9/2010 | Wyrick | F41J 1/10 273/390 |
| 2013/0147118 | A1 | 6/2013 | Matthis | |
| 2013/0328268 | A1 * | 12/2013 | Eggiman | F41J 7/04 273/378 |
| 2018/0058827 | A1 * | 3/2018 | Urban | F41J 1/10 |
| 2018/0087881 | A1 * | 3/2018 | Bickel | F41J 7/04 |
| 2019/0011229 | A1 * | 1/2019 | Babcock | F41J 1/10 |
| 2019/0249963 | A1 * | 8/2019 | Pendleton | F41J 5/18 |
| 2021/0033373 | A1 * | 2/2021 | Babcock | F41J 7/04 |
| 2021/0063123 | A1 * | 3/2021 | King | F41J 5/24 |
| 2021/0215465 | A1 * | 7/2021 | Guedon, II | F41J 7/04 |

* cited by examiner

SHOOTING TARGET

PRIORITY/CROSS-REFERENCE TO RELATED APPLICATIONS

This application claims the benefit of U.S. Provisional Application No. 63/06891, filed Aug. 21, 2020, the disclosure of which is incorporated by reference.

TECHNICAL FIELD

The disclosure generally relates to the field of shooting targets. The Particular embodiments relate to a modular target stand having a series of interchangeable target heads to allow for varying targets to be used by a shooter.

BACKGROUND

Firearm users utilize targets to shoot bullets or other projectiles at the targets. Shooting is a common sport, hobby and recreational activity for many people. Often targets have a shooting surface or target area and a stand or support to hold the shooting area. The shooting target is then positioned at a distance from where the shooter will shoot from. Depending on the type of firearm, such as a rifle, pistol, shotgun, or other firearm, the user will desire to utilize a different target surface to fire at. This can include a different shape, different thickness, and different metal or alloy strength or composition. Further, is it preferable that once the target has been positioned, the target remains stationary after being hit by multiple or sequential projectiles. For example, a user firing a pistol at a target will often empty a clip at the target with the clip carrying often between five and fifteen bullets. The user does not want to have to reset the target for each of these bullets.

While many varying targets exist, many of these targets do not provide the ability to interchange targeting surface along with an ease of positioning the target and transporting the target. Further, the targets can be difficult to position in an upright position without having additional support arms or being formed in with multiple legs. An additional issue is that many of the targets known to the inventor have a risk of the projectile ricocheting off the target surface back toward the shooter. Accordingly, what is needed is an improved target that provides modular interchangeability, ease of set up, and preferably improved safety in deflecting projectiles away from the shooter. What is further needed is a target that provides a center of mass target such that a shooter of a for example a pistol is shooting at the level generally where the center of mass of a human being would be.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

What is disclosed is a modular shooting target. The modular target has a head and a support pole. The support pole is configured to support said modular shooting target such that said support pole is vertically oriented from the ground when the support pole is positioned in or on the ground.

The head is preferably removable connected to the support pole. The head comprises an elongate rail. The rail extends in a horizontal orientation relative to the support pole when said support pole is supported by the ground. Preferably the head is in the shape of a hook, and more preferably a shepherd's hook.

A shooting target is removably attached to the head. The shooting target has a sleeve that is configured to slide over the elongate rail of the head section. A shooting surface is attached to or extends from the sleeve. The shooting surface can be a surface of a variety of shapes, with preferable shapes being a bell shape and a gong shape. The bell shape provides positive reinforcement of a ding sound when a shooter successfully shoots the bell target.

Preferably both the rail and sleeve are cylindrical such that the sleeve is allowed to rotate on the rail. In this embodiment preferably the shooting surface is configured to hang at an angle A from vertical such that a moment arm allows the shooting surface to hang from the rail to deflect projectiles into the ground. The moment arm preferably allows the shooting surface to hang at an angle between 5 degrees and 20 degrees from vertical. This angle allows the target to deflect projectiles shot onto said shooting surface down at the ground. Preferably this angle is 5 degrees, or alternatively 10 degrees. This offset from vertical helps prevent what is known as splashback in the shooting industry.

Preferably the head has a neck. The neck is preferably a cylindrical hollow tube that is positioned concentrically with the horizontal support tube. A connector such as a pin, R-pin, bolt, or other connector secures the head at the neck to the vertical support pole. Preferably the head including the neck are formed from rolled steel.

The vertical support tube is preferably configured with a first end that is configured for insertion into the ground. For example, the end can be configured as a reinforced point. Preferably a slide hammer is positioned on the vertical support near the first end. The slide hammer aides in positioning the first end into the ground. Preferably the first end has a fin extending outward from said support pole. The fin is configured to prevent rotation or spinning of the modular target when a projectile fired from a firearm hits the target.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE FIGURES

Figure 1:
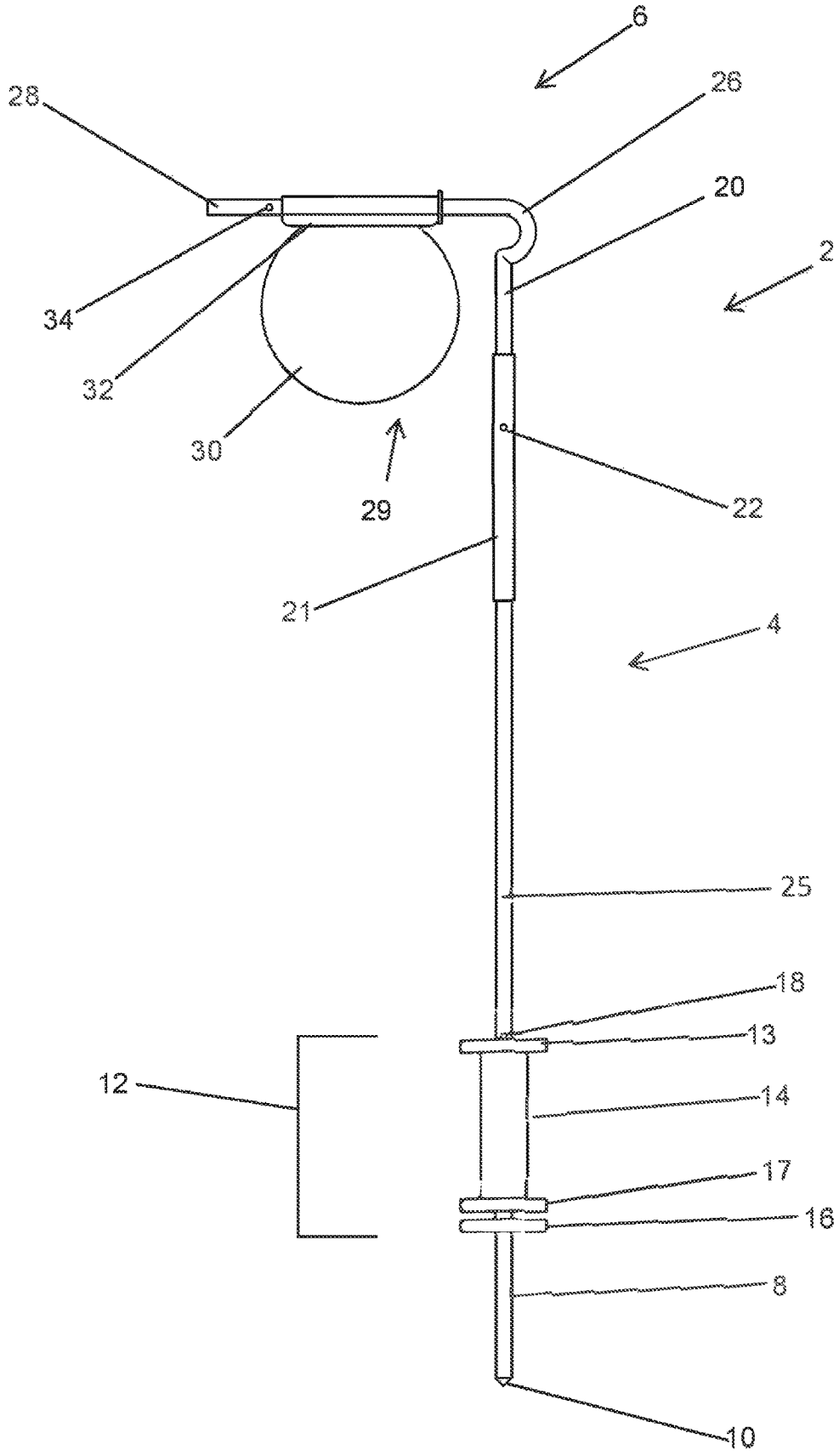
FIG. 1 is an isometric view of an embodiment of a shooting target and shooting target support.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

FIG. 1 illustrates a view of an improved target system 2, including an improved target 29 and improved target support system 4. The target support system utilizes a head assembly 6 that attaches to a support pole 25 that supports the head assembly 6. The body has a lower section 8 that is designed to be implanted into the ground. The lower section is preferably configured with a hardened tip 10 so as to facilitate the implantation of the body into the ground. The target system is modular with the target removable from the head, head removable from the support pole, and the depicted slide hammer removable from the support pole.

Preferably the body has a slide hammer 12 positioned above the section designed to be implanted into the ground. The slide hammer utilizes a shaft having a slide able weight 14 and a first flange 14 and a second flange 17. In operation a user grips the grip section 14 of the slide hammer and raises the weight upward along the shaft 20. The user then forcibly slides the weight downward toward the striking surface of the striking surface 16 attached to or integral with the body of the target. The impact of the second flange 17 on the striking surface 16 causes the lower section of the section of the body 8 to be forced into the ground. For transportation purposes, a opening 18 can be positioned above the slide hammer weight in a resting position such that an R-pin or other connector such as a pin or bolt can be positioned within the opening 18 to prevent the slide hammer weight from sliding during transport. Varying pins and/or bolts can also be used to secure the components of the invention together. A fin 36 is positioned on the lower section to prevent rotation of the target support system when the target support system is positioned in the ground and the target is being shot by a firearm.

The head has a neck 21 that is configured for mating engagement with the support pole 25. Alternatively the configuration can be reversed with the head having a rod section 20 that extends into the neck section 21. The neck section is of larger diameter than the support pole 25 so as to allow the neck to slide over the support pole. The support pole 25 and the neck section 22 each has an opening (shown in FIG. 5 as 55, 56) configured for to be concentric with the other such that a pin, bolt, or other connector can be positioned through the opening 22 to secure the head to the neck. The neck has a generally shepherd's hook appearance such that the head has a bend 26 that transitions to a generally horizontal rod (also called rail) section 28. The horizontal rod section is configured with a removable target surface 29. In the depicted embodiment, the removable target surface has a tubular section or sleeve 32 that is configured to slide onto the horizontal rod section 28 of the head. In the depicted embodiment, a generally circular gong 30 is attached to the sleeve, more specifically the gong is welded to the sleeve. The gong and sleeve are configured to be slid onto and off of the rail. In a preferred embodiment, the round gong section 30 is attached to the tubular section so as to be at an angle relative to vertical to deflect projectiles down to the ground beneath the gong. In a preferred embodiment the gong is positioned at a generally five (5) to twenty (20) degree angle from vertical when the target is in use, with a preferred angle of 10 degrees. This approximately ten (10) degree angle is shown, for example, in FIG. 3. The gong and sleeve are configured to provide a moment arm when attached to the rail such that the gong hangs from the rail at an angle. The generally horizontal section of tubular rod is configured with an opening 34 therethrough configured for a pin or bolt to be positioned to prevent removal of the target surface 29. Preferably each of the components is made of rolled steel.

Figure 2:
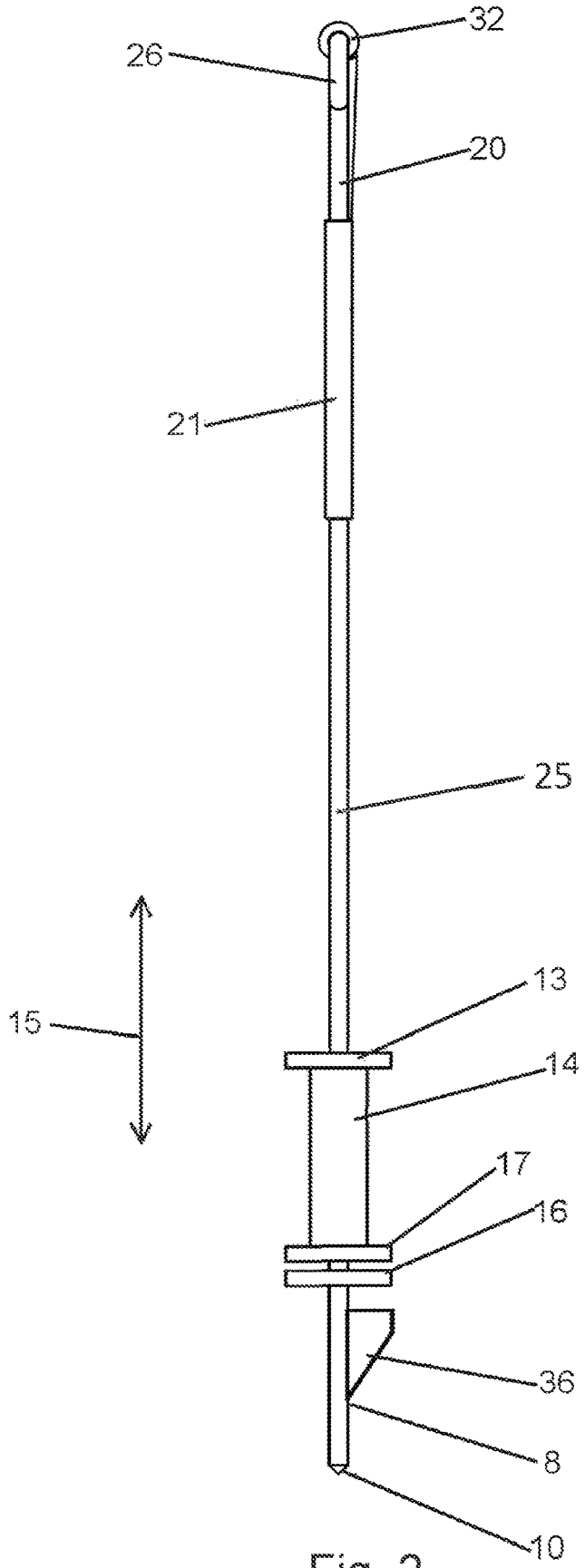
FIG. 2 is a side isometric view of an embodiment of a shooting target and shooting target support.

FIG. 2 depicts a side view of a preferred embodiment of the invention. The angle of the target surface to the horizontal rod is further illustrated. In addition, a preferred this fin 36 is positioned projecting generally at a 90 degree angle to the orientation of the shooting surface. This then prevents the rotation of the target when a projectile impacts the shooting surface.

Figure 3:
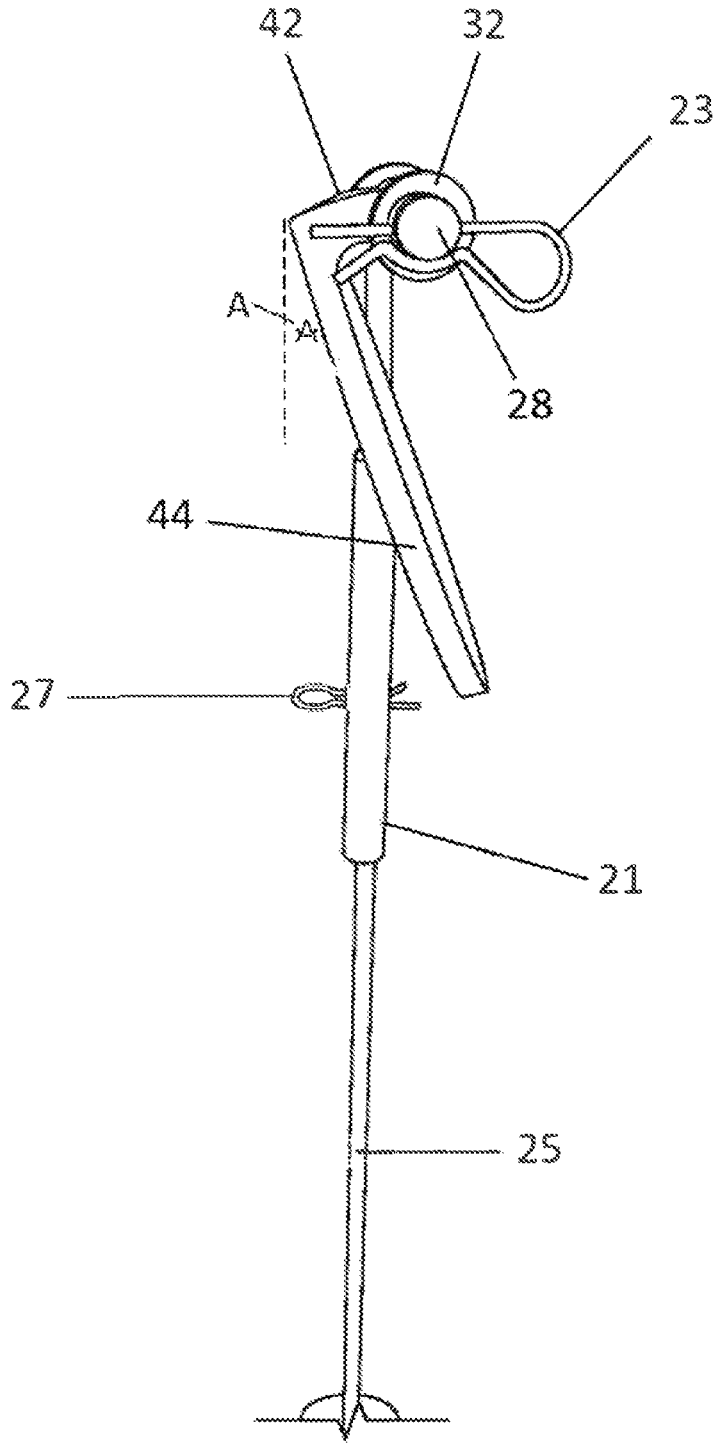
FIG. 3 is a side perspective view of a shooting target and shooting target support

FIG. 3 illustrates a preferred embodiment of a target attached to the target support of FIGS. 1-2. The gong is formed or connected 42 to the sleeve 32 to provide a moment arm to allow the gong to hang at an angle relative to the sleeve. The moment arm causes the face 44 of the gong to provide a non-perpendicular shooting surface that deflects projectiles downward at the ground, as opposed to back at the shooter. In other words, the construction of the gong face causes the gong and sleeve to balance on the rail at the angle at which the gong directs projectiles downward, but allows the gong and sleeve to rotate on the rail when impacted by a projectile on the gong face. The target and sleeve are configured to allow for rotation of the sleeve around the rail when impacted by a projectile, and gravity causes the gong to rotate back to the depicted position. R-pins 23, 27 are illustrated securing the sleeve 32 to the rail 28. The target can be made of a variety of materials, including AR500 steel, AR550 steel, or alternative target material such as a hardened plastic or archery target. Preferably the target material is selected to provide an audible feedback such as a ping or a ding when a projectile hits the target surface.

The target surface can be provided with a series of modular target surfaces. These include, but are not limited to, a head that is provided in a generally t-shape with opposing gongs. Alternatively, the head can be provided with a horizontal section for the positioning of an archery target on top of the head.

Figure 4:
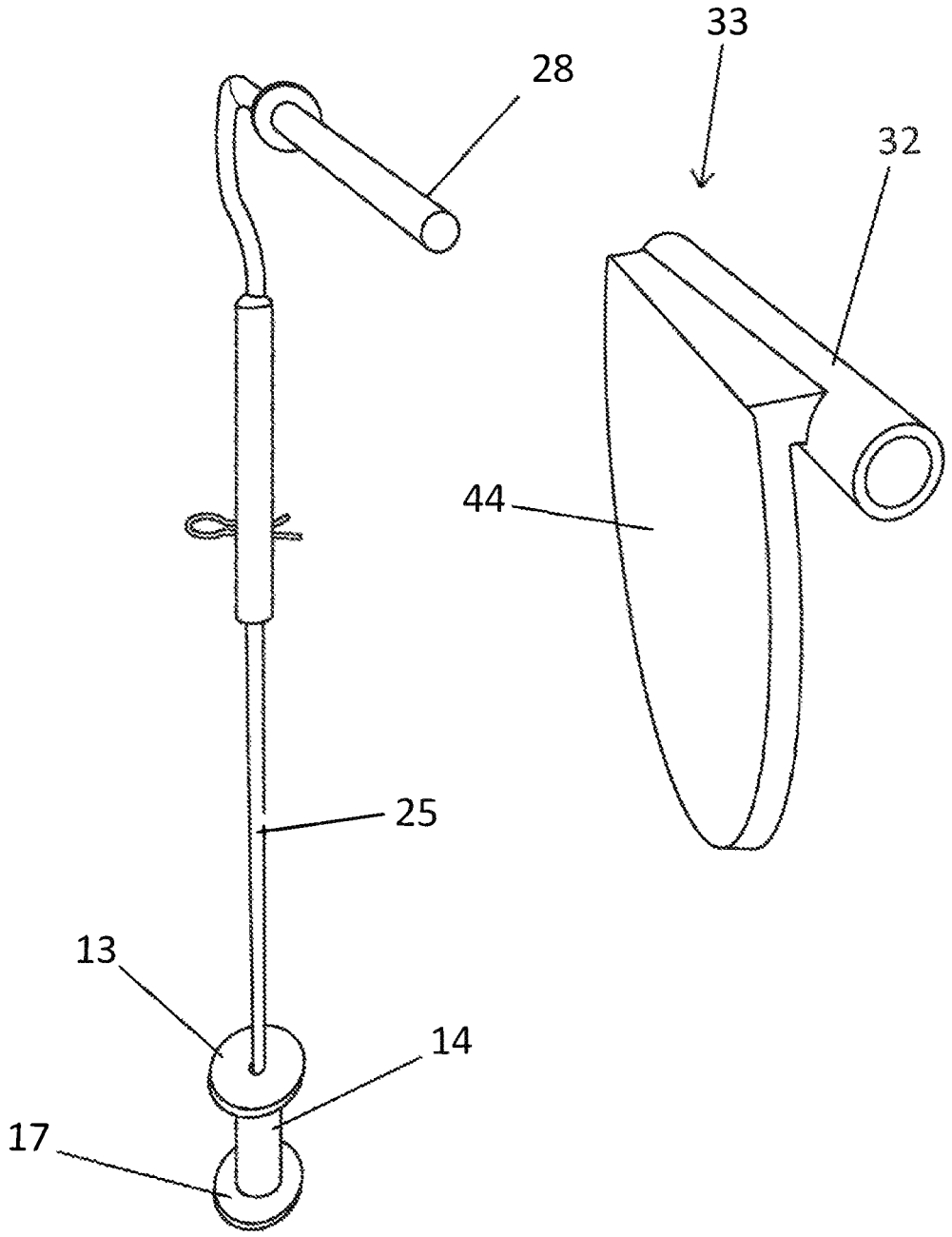
FIG. 4 is a partially exploded view of the a shooting target and shooting target support of FIG. 3.

FIG. 4 illustrates an exploded view of a target 33 having sleeve 32 and shooting surface 44 removed from the rail 28.

Figure 5:
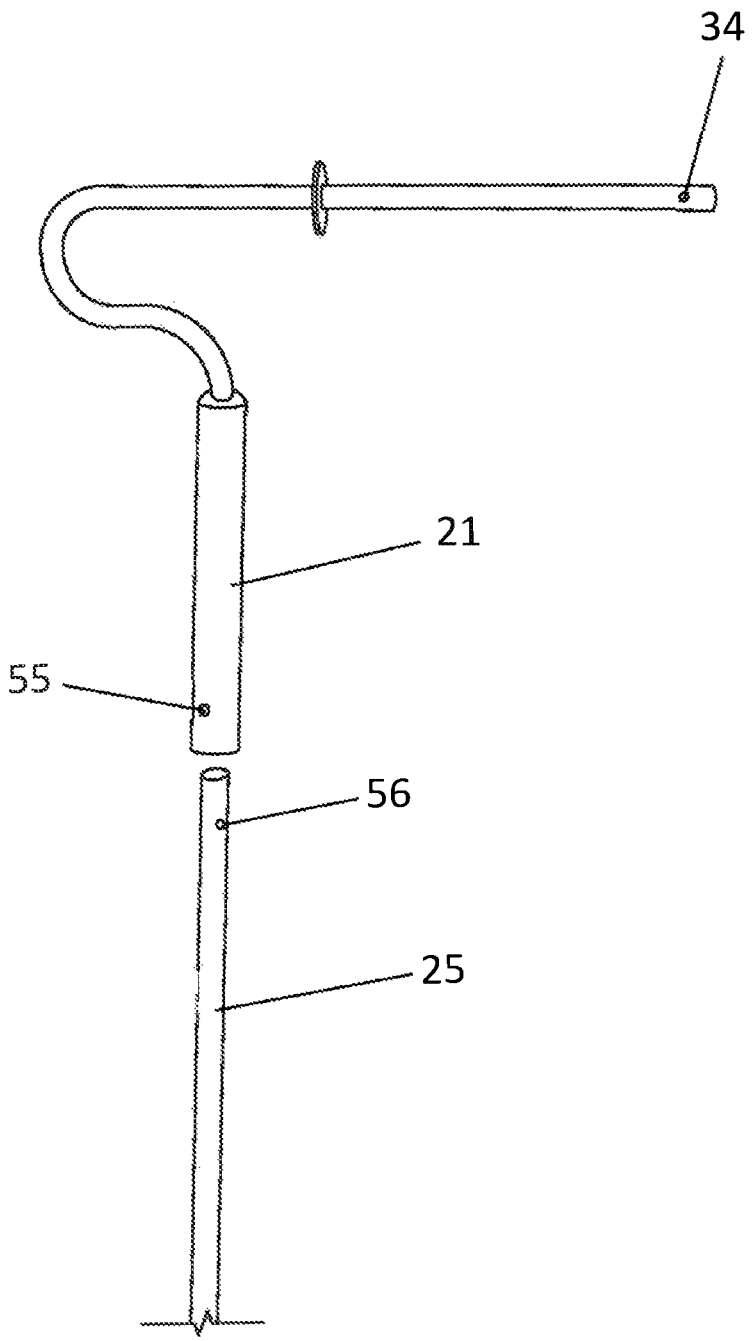
FIG. 5 is a perspective view of the shooting target support of FIGS. 3 and 4.
Figure 6:
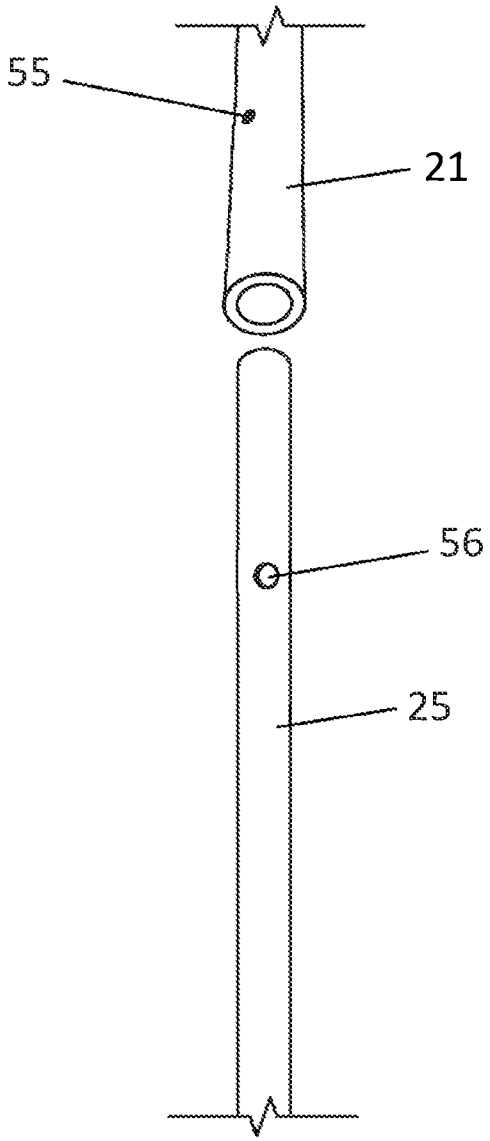
FIG. 6 is an exploded view of the junction of a neck of a head of a shooting target support relative to the support pole of the shooting target support.

FIGS. 5 and 6 illustrate the modularity of the head and neck to the support pole 25. The neck 21 is configured to slied over the support pole and allow for alignment of openings 55, 56 to allow for a connector to secure the head and neck to the support pole.

Figure 7:
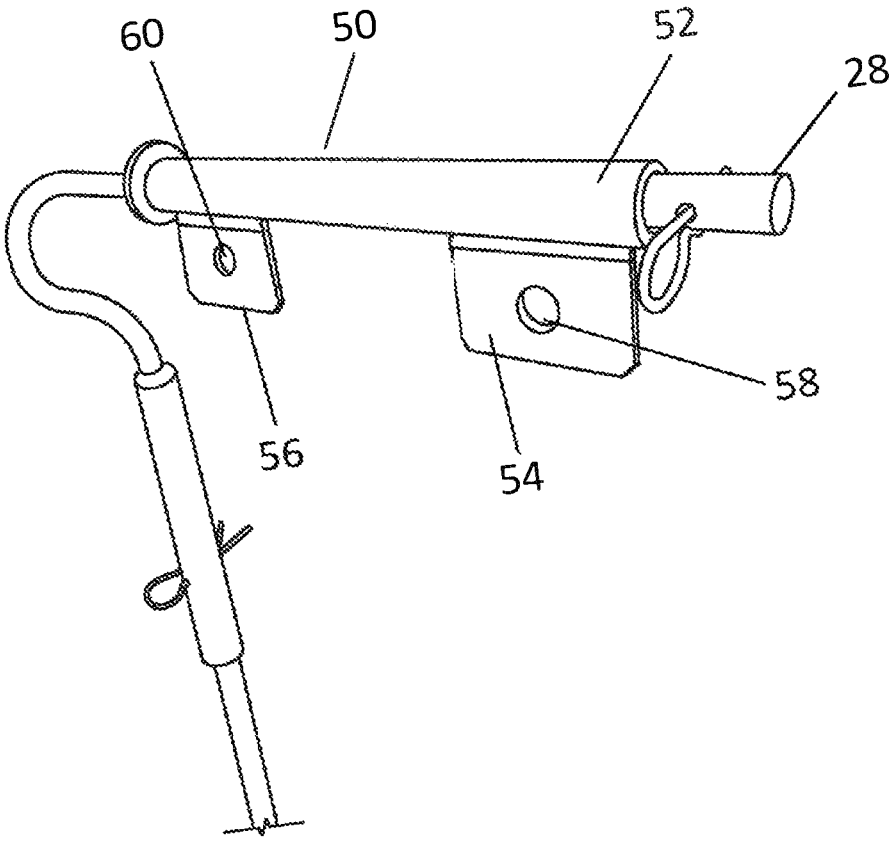
FIG. 7 is a perspective view of a shooting target support and alternate shooting target connector for use of hanging shooting targets.

FIG. 7 illustrates an alternate configuration 50 of a target having a sleeve 52 positioned on the rail 28. The sleeve has two tabs 54, 56 that form attachments connected to the sleeve. The tabs have openings 58, 60 configured for connection to a chain, to support prior art shooting gongs that hang by chain to the two connection points. The tabs are configured by the openings to attach chains or other target hanging configurations.

Figure 8:
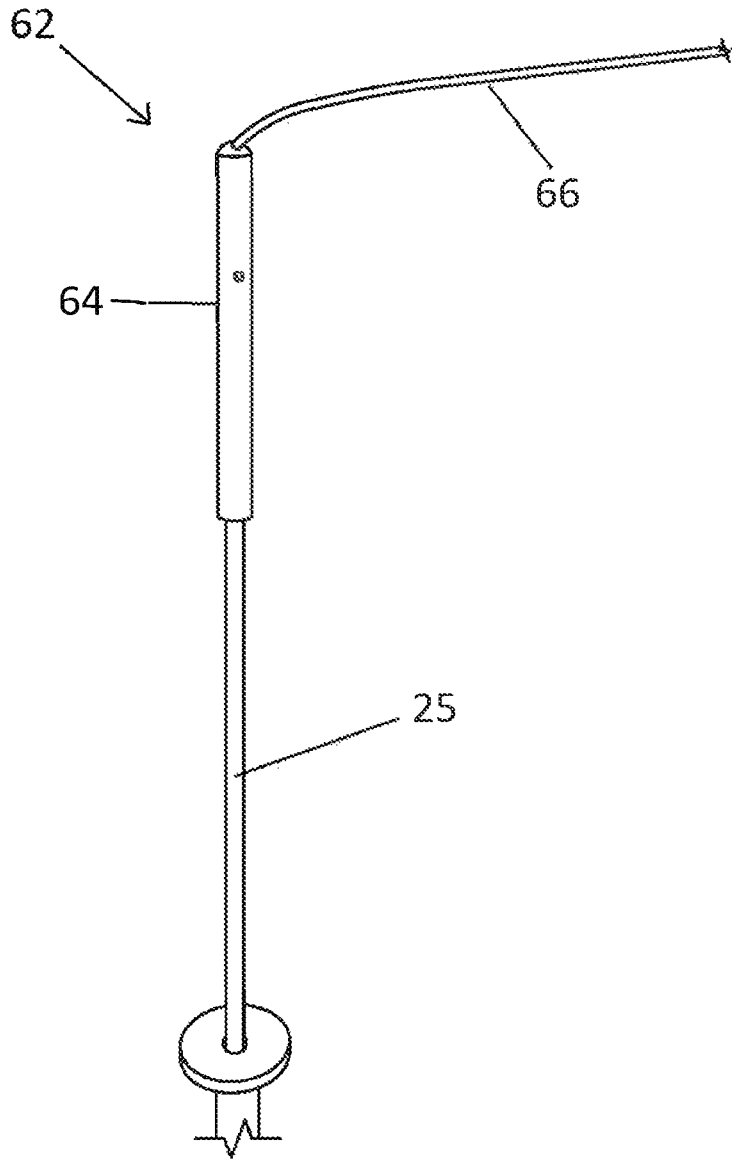
FIG. 8 is a perspective view of a shooting target support having a second embodiment of a head configured for attachment of a paper target.

FIG. 8 illustrates an alternate configuration of a head 62 configure for attachment to a paper shooting target or other shooting target. The head has a neck 46 that is configured for positioning on to the support rail 25. The head has an extension rail 66 for attaching a paper target. The extension arm allows a paper target or other target to hang below the rail.

Figure 9:
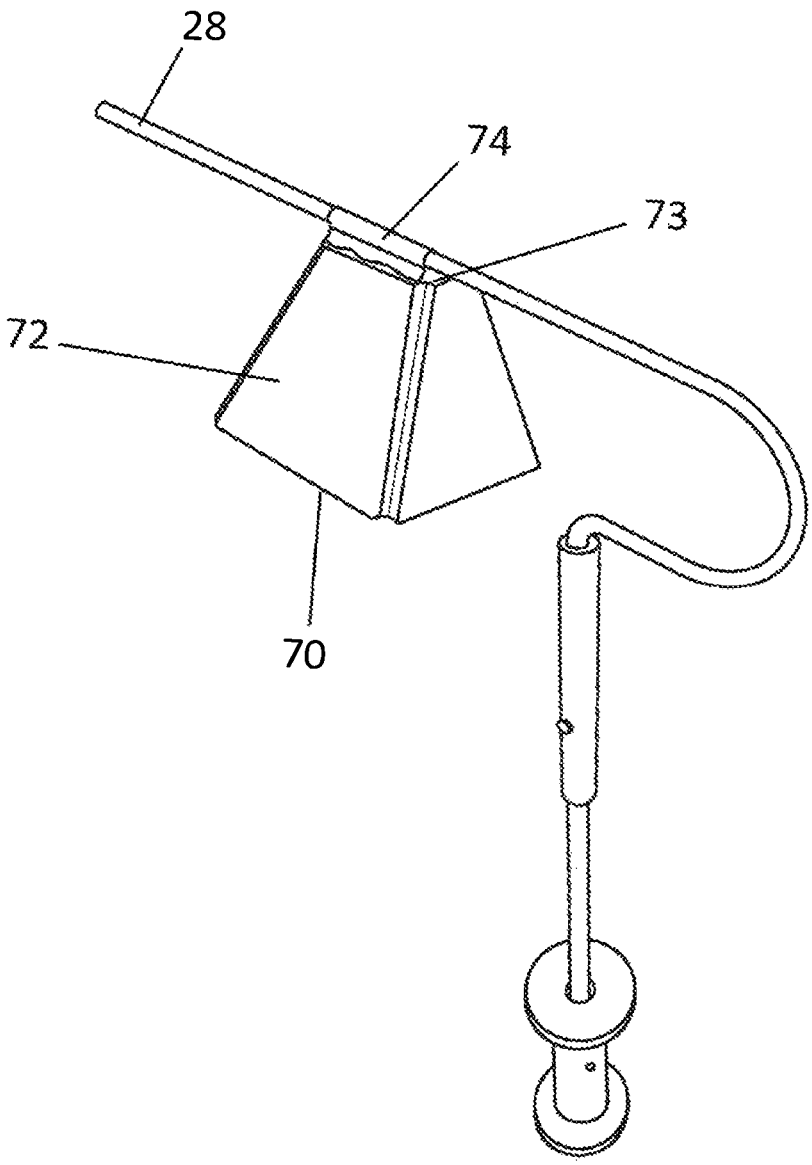
FIG. 9 is a perspective view of a shooting target support supporting a bell target.

FIG. 9 illustrates an alternate embodiment of a shooting target provided in a bell configuration. The depicted bell 70 has four sides (two sides shown) and a top 73. The bell can alternatively have three or more sides. The bell has a shooting face 72. The bell has a sleeve positioned at or near the top of the bell. The sleeve is configured for sliding onto the rail 28 of the target support. The bell is preferably attached to or formed to the sleeve such that a moment arm causes the shooting face of the bell to hang at an angle of five (5) degrees to twenty (20) degrees, with a preferred angle of 10 degrees. The moment arm and angle is depicted more clearly in FIG. 3. The bell can be configured with or without a clapper, with a preferred configuration being without a clapper.

Still other features and advantages of the presently disclosed and claimed inventive concept(s) will become readily apparent to those skilled in this art from the following detailed description describing preferred embodiments of the inventive concept(s), simply by way of illustration of the contemplated embodiments carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

While certain preferred embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A modular shooting target comprising:

a support pole configured to support said modular shooting target such that said support pole is vertically oriented from the ground, said support pole comprising a first end and a second end;

a head connected to said support pole, said head comprises an elongate rail, wherein said elongate rail extends in a horizontal orientation to said support pole when said support pole is supported by the ground;

a shooting target, wherein said shooting target comprises an elongate sleeve configured for removable positioning on said rail of said head, wherein said shooting target comprises a shooting surface connected to said sleeve a slide hammer positioned between said first end of said support pole and said second end of said support pole, wherein said slide hammer is configured to impart force to said support pole to drive said first end of said support pole into the ground; and a fin extending outward from said support pole proximate to said first end, wherein said fin is configured to prevent said modular shooting target from spinning when a projectile fired from a firearm hits said modular shooting target.

2. The modular shooting target of claim 1, wherein said elongate rail comprises an elongate tubular rail, wherein said elongate sleeve comprises an elongate tubular sleeve, wherein said elongate tubular sleeve is configured for rotation on said elongate tubular rail.

3. The modular shooting target of claim 2, wherein said shooting surface is configured to hang at an angle from vertical at a moment arm to deflect projectiles shot onto said shooting surface down at the ground.

4. The modular shooting target of claim 3, wherein said angle is from 5 degrees to 20 degrees.

5. The modular shooting target of claim 3, wherein said shooting surface comprises a gong, wherein said gong is connected to said tube such that said gong is configured to extend at a 10 degree angle from said head when said support pole is mounted vertically in the ground.

6. The modular shooting target of claim 3, wherein said head and said body comprise rolled steel.

7. The modular shooting target of claim 1, wherein said shooting target comprises a bell, wherein said shooting surface of said target comprises a surface of said bell.

8. The modular shooting target of claim 1, wherein said head comprises a generally vertical section comprising a neck, wherein said neck is configured for releasable attachment to said support pole.

9. The modular shooting target of claim 8, wherein said shooting surface comprises a paper target.

10. The modular shooting target of claim 1, wherein a pin secures at least one of said neck to said support pole and said head to said shooting target.

11. The modular shooting target of claim 1, wherein said shooting target comprises a gong.

12. The modular shooting target of claim 1, wherein said first end of said support pole is configured for insertion into the ground.

13. The modular shooting target of claim 1, wherein said sleeve are configured to hang a removable target.

14. A shooting target comprising:

a support pole configured to support said modular shooting target such that said support pole is vertically oriented from the ground, said support pole comprising a first end and a second end;

a head connected to said support pole, said head comprising a shooting surface;

a slide hammer positioned between said first end of said support pole and said second end of said support pole, wherein said slide hammer is configured to impart force to said support pole to drive said first end of said support pole into the ground; and a fin extending outward from said support pole proximate to said first end, wherein said fin is configured to prevent said modular shooting target from spinning when a projectile fired from a firearm hits said modular shooting target.

15. The shooting target of claim 14, wherein said first end of said support pole is configured for insertion into the ground.

16. The shooting target of claim 14, wherein said shooting surface is configured to hang at an angle from vertical at a moment arm to deflect projectiles shot onto said shooting surface down at the ground.

17. The shooting target of claim 16, wherein said angle is from 5 degrees to 20 degrees.

* * * * *